US008397465B2

(12) United States Patent
Hansbro et al.

(10) Patent No.: US 8,397,465 B2
(45) Date of Patent: Mar. 19, 2013

(54) CONTINUOUSLY INSULATED WALL ASSEMBLY

(75) Inventors: Jeffrey M. Hansbro, Evanston, IL (US); Michael J. Kontranowski, Midland, MI (US); Daniel R. Schroer, Saginaw, MI (US); Daniel A. Tempas, Midland, MI (US)

(73) Assignee: Dow Global Technologies LLC, Midland, MI (US)

( * ) Notice: Subject to any disclaimer, the term of this patent is extended or adjusted under 35 U.S.C. 154(b) by 257 days.

(21) Appl. No.: 12/483,331

(22) Filed: Jun. 12, 2009

(65) Prior Publication Data

US 2009/0320397 A1 Dec. 31, 2009

Related U.S. Application Data

(60) Provisional application No. 61/076,174, filed on Jun. 27, 2008.

(51) Int. Cl.
*E04B 1/00* (2006.01)

(52) U.S. Cl. ..... 52/745.09; 52/309.14; 52/483.1

(58) Field of Classification Search ..... 52/309.14, 52/309.9, 378, 417, 418, 481.1, 483.1, 745.09, 52/235, 489.1, 281
See application file for complete search history.

(56) References Cited

U.S. PATENT DOCUMENTS

| | | | | |
|---|---|---|---|---|
| 4,522,004 | A * | 6/1985 | Evans et al. | 52/409 |
| 4,564,554 | A | 1/1986 | Mikuski | |
| 4,924,647 | A | 5/1990 | Drucker | |
| 5,027,572 | A | 7/1991 | Purcell et al. | |
| 5,345,738 | A * | 9/1994 | Dimakis | 52/309.9 |
| 5,979,131 | A | 11/1999 | Remmele et al. | |
| 6,006,481 | A * | 12/1999 | Jacobs | 52/309.9 |
| 6,122,877 | A * | 9/2000 | Hendrickson et al. | 52/520 |
| 6,202,377 | B1 * | 3/2001 | Krieger | 52/489.1 |
| 6,209,281 | B1 * | 4/2001 | Rice | 52/714 |
| 6,408,580 | B1 * | 6/2002 | Jurvis et al. | 52/233 |
| 6,619,004 | B2 | 9/2003 | Loper | |
| 6,745,531 | B1 * | 6/2004 | Egan | 52/302.1 |
| 6,837,013 | B2 * | 1/2005 | Foderberg et al. | 52/356 |
| 6,886,301 | B2 | 5/2005 | Schilger | |
| 6,898,908 | B2 * | 5/2005 | Messenger et al. | 52/268 |
| 7,343,716 | B2 * | 3/2008 | Nordgren et al. | 52/506.01 |
| 7,677,002 | B2 * | 3/2010 | Bennett et al. | 52/408 |
| 7,712,277 | B2 * | 5/2010 | Swanson | 52/541 |
| 7,870,699 | B2 * | 1/2011 | Waggoner | 52/518 |
| 8,117,801 | B2 * | 2/2012 | Jambois et al. | 52/748.1 |
| 2002/0069600 | A1 * | 6/2002 | Bryant | 52/309.9 |
| 2008/0120932 | A1 | 5/2008 | Paradis | |

* cited by examiner

*Primary Examiner* — William Gilbert
*Assistant Examiner* — Gisele Ford
(74) *Attorney, Agent, or Firm* — Steven W. Mork

(57) ABSTRACT

Construct a wall assembly by: (a) providing a support structure with spaced apart structural members; (b) affixing a thermally insulating layer of polymeric foam boards to the structural members, the foam boards achieving a Class A rating according to ASTM E-84; (c) covering seams between polymeric foam boards with a sealing tape; (d) affixing a plurality of fasteners through the thermally insulating layer to structural members with the fasteners extending beyond the outside surface of the thermally insulating layer; (e) attaching a façade selected from metal panel, metal-composite-metal panels, fiber reinforced cementitious siding veneer and materials having a thickness of at least 1.9 centimeters (0.75 inches) that qualify as "non-combustible" according to ASTM E136 to the fasteners and within five centimeters of the thermally insulating layer; and desirably (f) applying a spray polyurethane foam material to seal gaps through the thermally insulating layer; the process being free of applying gypsum sheathing layer or wood-based sheathing between structural members and the thermally insulating layer.

16 Claims, 1 Drawing Sheet

CONTINUOUSLY INSULATED WALL ASSEMBLY

CROSS REFERENCE STATEMENT

This application claims the benefit of U.S. Provisional Application No. 61/076,174, filed Jun. 27, 2008.

BACKGROUND OF THE INVENTION

1. Field of the Invention

The present invention relates to a continuously insulated building wall assembly suitable for use in commercial buildings and a method for assembling such wall assembly.

2. Description of Related Art

Commercial buildings in North America are regulated by numerous building codes. American Society of Heating, Refrigerating and Air-Conditioning Engineers (ASHRAE) standard 90.1-2007 prescribes thermal insulation requirements, which can require continuous insulation as part of a wall structure. National Fire Protection Association (NFPA) standard 285 identifies flame propagation requirements for exterior non-load bearing wall assemblies. American Society for Testing and Materials (ASTM) standard E-331 dictates water barrier property requirements. ASTM E-2357 dictates air barrier property requirements. In addition to code requirements, designers and builders demand that the building materials be durable enough to withstand at least six months of exposure to elements of weather in any season and rough job site handling without damage or deterioration. In order to meet the stringent demands, commercial buildings often comprise wall systems containing a support framework (for example, a network of studs) with multiple building components on and within the support framework.

Use of exterior grade gypsum board as a substrate over an outer surface of structural members such as studs is common in the industry to create wall structures that meet these stringent building codes. For example, exterior insulation finish systems (EIFS) are one type of common wall system for use in building structures. EIFS use an exterior grade gypsum board as a substrate over structural members such as wall studs. Insulating foam applied over the gypsum board provides thermal insulation. Tape or fillers typically seal seams between gypsum boards and/or insulating foam boards. The EIFS can also include a water barrier membrane to improve water barrier properties (see, for example U.S. Pat. No. 5,027,572 which teaches use of a polyethylene film between the gypsum board layer and thermal insulation layer). Such a wall system suffers from numerous drawbacks. Gypsum board is dense, heavy material that makes installation of the wall system labor-intensive and cumbersome. The wall system requires numerous layers of materials (cavity insulation, gypsum board, water barrier, seam sealing and a thermal insulating barrier) in order to achieve the demanding building code requirements, which in turn require extensive time for installation. Materials such as gypsum board can also suffer from deterioration if moisture penetrates into the gypsum board, a not-unlikely problem in humid or rainy environments.

Wall systems further typically include a water vapor barrier material adjacent to either the inside surface or outside surface of the structural members as well as fiber batting insulation within cavities between structural support members. The water vapor barrier material serves to hinder penetration of moisture into a cavity space between structural support members. Moisture can be particularly problematic in the cavity space when a surface in the cavity space is at a temperature below the dew point of the humidity in the cavity, which results in condensation of the moisture on the cold surface. Fiber batting insulation tends to exacerbate trapping moisture within the cavity spacing between structural members by: (1) insulating the cold surface within the cavity from warmth from the warmer surfaces thereby allowing the cold surface to get colder and induce more condensation than had the insulation not been present; and (2) dramatically increasing the path through which moisture must travel through the cavity space to escape from the cavity space.

A wall assembly that meets the necessary commercial building codes but that does not require gypsum board, or similarly heavy-weight substrate, on the outer surface of the structural members is desirable. Even more desirable is a wall assembly that includes a substrate that is lighter-weight than either gypsum or wood based substrates and that inherently provides a continuous thermal insulating layer to meet ASHRAE 90.1-2007 requirements without requiring both a substrate layer and a thermally insulating layer. Moreover, such a wall assembly would be even more desirable if it would not suffer from deterioration in humid or moist environments. Yet more desirable would be a wall assembly with any combination of these features that is also durable to handling on a job site and open exposure on a building structure for extended periods of time. Yet even more desirable is a wall assembly that inhibits moisture condensation within a cavity spacing between structural members by inhibiting any surface within the cavity spacing from becoming cool enough to reach the dew point for the cavity spacing. Preferably, it would be desirable to have a wall system that does not require a water vapor barrier material to preclude condensation of moisture within a cavity space between structural members. Moreover, it would be desirable to have a wall system that does not require fiber batting in a cavity spacing between structural members in order to achieve desirable thermal insulating properties.

BRIEF SUMMARY OF THE INVENTION

The present invention is an alternative to the gypsum-board based wall assemblies common in commercial construction. Surprisingly, the present invention is able to achieve all of the necessary building code requirements cited in the Background section, including providing a continuous insulating layer, while using a polymeric foam-based layer without a separate substrate layer (for example, a gypsum-board layer). The present invention reduces the number of external wall components needed, thereby making installation of building structural assemblies less labor intensive than with current wall assemblies. Moreover, the weight of the wall assembly is dramatically less than wall systems comprising separate thermally insulating and substrate layers, which also makes installation less labor intensive. Still more, the present wall assembly does not suffer from deterioration in humid or moist environments. Embodiments of the present wall assembly also offer durability sufficient to meet job site handling and exposure demands of builders.

In a first aspect the present invention is a continuously insulated wall assembly comprising the following elements: (a) a support structure comprising structural members spaced apart from one another and defining a cavity between any two structural members; (b) a thermally insulating layer comprising a plurality of polymeric foam boards each having opposing inside and outside surfaces with the inside surfaces attached to two or more of the structural members so as to create a cavity defined by structural members and the thermally insulating layer, the polymeric boards abutting one another with seams where the boards abut and characterized by achieving a Class A rating according to ASTM E-84 test procedures and by having an R-value of greater than 28 meters*Kelvin per Watt (4 hour*square foot*degrees Fahrenheit per British Thermal Unit*inch); (c) sealing tape covering seams where the polymeric foam boards abut one another; (d) a plurality of fasteners that are affixed to structural members and all the way through component (b) and that extend beyond the outside surface of (b); and (e) a façade attached to one or more fastener and located within five centimeters of (b) such that (b) and (c) are between the façade and (a); the façade being selected from a group consisting of metal panel veneer, metal-composite-metal panels, fiber reinforced cementitious siding veneer and materials having a thickness of at least 1.9 centimeters (0.75 inches) that qualify as "non-combustible" according to ASTM E136.

Particular embodiments of the continuously insulated wall assembly of the present invention include one or any combination of more than one of the following additional characteristics: the façade is selected from a group consisting of brick veneer, stucco veneer that is at least 0.75 inches thick, metal panel veneer, metal-composite-metal panels and terra-cotta; having a sealant within the cavity defined by the structural members and thermally insulating layer that seals air gaps having openings of less than 25 square millimeters between the inside and outside surfaces of the thermally insulating layer, preferably wherein the sealant is a polyurethane foam, more preferably wherein the polyurethane foam covers all portions of elements (b), (c) and (d) that would otherwise be exposed within the cavity defined by (a) and (b) and/or wherein the polyurethane foam forms a layer over the thermally insulating layer that has an average thickness of 2.54 to 5.08 centimeters thick; the polymeric foam boards of the thermally insulating layer having as an outside surface a facer selected from facers comprising one or more of the following: a metal sheet layer and a coated glass fiber mat where the coating comprise a polymeric binder filled with inorganic filler such that 90-95 wt % of the coated glass fiber mat is a combination of glass and inorganic filler; the polymeric foam boards having as an outside surface a facer comprising a continuous layer of aluminum sheet; being free of any gypsum sheathing layer that covers 50% or more of the area covered by (b) and on the same side of (a) as elements (b) and (c); being free of any gypsum sheathing layer on the same side of (a) as elements (b) and (c); being free of vertical drainage channels on the inside surface, outside surface or both inside and outside surface of (b); (b) having a density of 48 kilograms per cubic meter or less; the thermally insulating layer comprising a polyurethane foam having glass dispersed therein; (b) having an outside surface comprising a facer comprising a continuous aluminum sheet that is at least 0.0078 millimeters (3 mils) thick, preferably wherein the aluminum sheet is coated with a crosslinked polymer coating; the polymeric foam boards of (b) having both an outside and inside surface comprising a continuous aluminum sheet having a thickness of less than 0.125 millimeters (five mils); the sealing tape extending over less than an entire polymeric foam board in contact with the sealing tape; the sealing tape composition comprising a butyl rubber or asphalt; the sealing tape comprising a butyl rubber layer and an olefinic polymer layer; the sealing tape comprising a butyl rubber layer that is at least 0.25 millimeters (10 mils) thick; a space of 2.5-5 centimeters between (b) and (e); the façade being a brick veneer; the façade being a metal panel veneer; the façade comprising stucco; and further comprising a gypsum board layer on a side of the structural members opposite (b) such that the gypsum board serves to further enclose a cavity defined by (a) and (b).

In a second aspect, the present invention is a process for assembling a continuously insulated wall assembly comprising the following steps: (a) providing a support structure comprising structural members spaced apart from one another so as to define a cavity between structural members; (b) providing a thermally insulating layer comprising a plurality of polymeric foam boards each having opposing inside and outside surfaces with the inside surfaces attached to two or more of the structural members so as to create a cavity defined by structural members and the thermally insulating layer, the polymeric boards abutting one another with seams where the boards abut and characterized by achieving a Class A rating according to ASTM E-84 test procedures and by having an R-value of greater than 28 meters*Kelvin per Watt (4 hour*square foot*degrees Fahrenheit per British Thermal Unit*inch); providing a sealing tape that contains butyl rubber, rubberized asphalt, or both and covering the seams between polymeric foam boards with the sealing tape; (d) providing a plurality of fasteners and affixing them all the way through the thermally insulating layer to structural members such that the fasteners extend beyond the outside surface of the thermally insulating layer; and (e) attaching a façade to one or more than one fastener and within five centimeters of the thermally insulating layer such that the thermally insulating layer and sealing tape are between the structural members and the façade, the façade being selected from a group consisting of metal panel veneer, metal-composite-metal panels, fiber reinforced cementitious siding veneer and materials having a thickness of at least 1.9 centimeters (0.75 inches) that qualify as "non-combustible" according to ASTM E136; the process further characterized by being free of application of a gypsum sheathing layer or wood-based sheathing layer between the structural members and thermally insulating layer.

Particular embodiments of the second aspect of the present invention include one or any combination of more than one of the following additional characteristics: the façade is selected from a group consisting of brick veneer, stucco veneer that is at least 0.75 inches thick, metal panel veneer, metal-composite-metal panels and terra-cotta; applying a sealant within the cavity defined by the structural members and the thermally insulating layer in a manner that seals air gaps between inside and outside surfaces of the thermally insulating layer; the sealant is a spray polyurethane foam material; the polymeric foam boards of the thermally insulating layer have as an outside surface a facer selected from facers comprising one or more of the following: a metal sheet layer and a coated glass fiber mat where the coating comprise a polymeric binder filled with inorganic filler such that 90-95 wt % of the coated glass fiber mat is a combination of glass and inorganic filler; and the polymeric foam boards have as an outside surface a facer comprising a continuous layer of aluminum sheet.

The process of the present invention is useful for preparing the wall assembly of the present invention. The wall assembly of the present invention is useful for constructing buildings, especially commercial buildings.

BRIEF DESCRIPTION OF THE DRAWINGS

FIG. 1(*b*) illustrates a top-down view of the insulated wall assembly of FIG. 1(*a*) as viewed along viewing line B.

DETAILED DESCRIPTION OF THE INVENTION

Figure 1A:
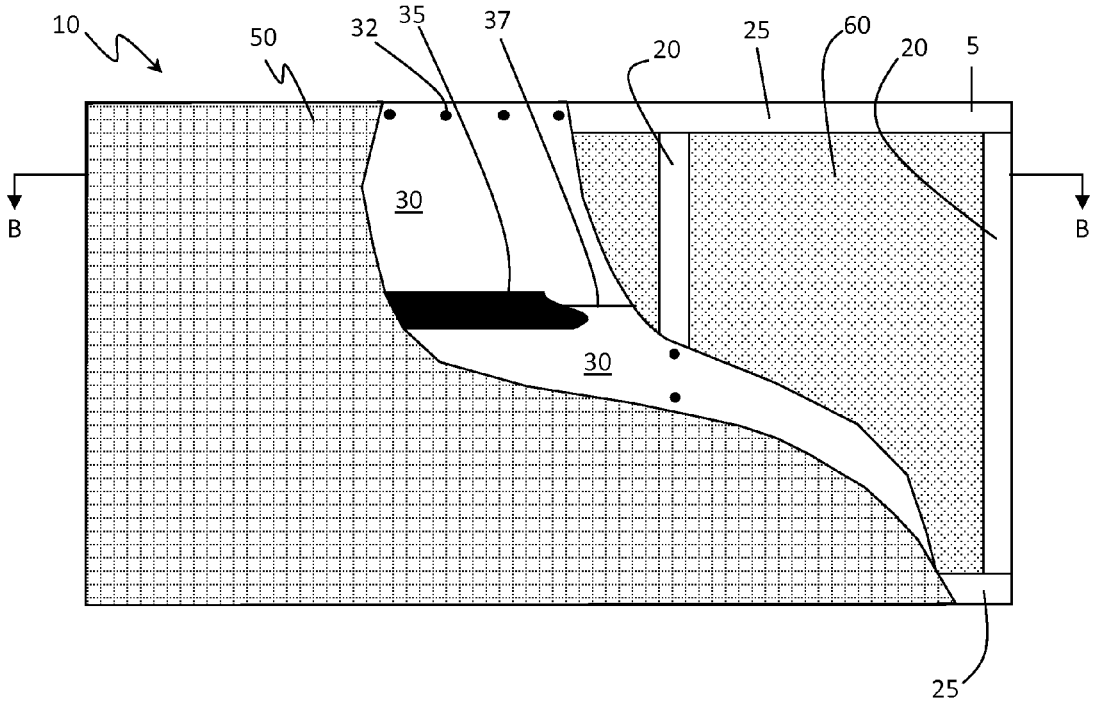
FIG. 1(*a*) illustrates a cut-away front face view of an insulated wall assembly of the present invention. The cut-away view illustrates staggered cut-away sections revealing subsequent layers of the wall assembly.

"ASTM" refers to American Society for Testing and Materials and is used to identify a test method by number. The year of the test method is either identified by suffix following the test number or is the most recent test method prior to the priority date of this document. The procedure of a test method may apply to materials other than those for which the test method is particularly designed. For example, a test method may be for thermoplastic foam yet a skilled artisan recognizes that the test method may also be useful to characterize properties of thermoset foam. In that regard, the test methods identified herein adopt the test method procedure as applied to the material noted in the present specification regardless of the intentions noted in the actual test method.

All ranges include endpoints unless otherwise indicated.

The present invention includes a support structure. The support structure comprises structural members spaced apart from one another. The space between structural members is a type of cavity having structural members occupying a perimeter around the cavity. Common support structures include wall structures having spaced apart studs. Desirably, the present invention comprises a support structure with spaced apart metal studs. Metal studs are desirable over wood studs because metal studs offer greater fire retardancy and greater strength and integrity in the final continuously insulated wall assembly. Steel studs are particularly desirable and common forms of structural elements. The support structure has opposing inside and outside surfaces separated by a depth, which is the depth of the cavity between structural members as well as the depth of each structural member. Depths of the structural members are not limited, but typically are approximately 8.9 centimeters (3.5 inches) or more, even 9.2 centimeters (3.625 inches) or more and can be 14 centimeters (5.5 inches) or more. Greater depths allow for increased insulation within the cavity between structural elements which can be desirable to achieve higher thermal insulation for the continuously insulated wall assembly.

A thermally insulating layer contacts and attaches to the outside surface of the support structure by contacting and attaching to the structural members. The thermally insulating layer serves to further enclose and define cavities (or "cavity space") between structural elements. The thermally insulating layer comprises multiple polymeric foam boards abutting one another thereby creating seams between the polymeric foam boards. Unlike other structural walls, the continuously insulated wall assembly of the present invention does not require a separate substrate layer of, for example, gypsum board either between the thermally insulating layer and the support structure or between the thermally insulating layer and a façade over the thermally insulating layer. In fact, the thermally insulating layer desirably directly contacts the structural members of the support structure. The thermally insulating layer is continuous and therefore satisfies ASHRAE 90.1-2007 prescriptions for a continuous thermal insulating layer. "Continuous" in regards to the thermally insulating layer assumes the meaning of the ASHRAE 90.1-2007 code and provides for openings such as those for doors, windows and vents.

Each polymeric foam board of the thermally insulating layer has opposing inside and outside surfaces, which in aggregate respectively define inside and outside surfaces of the thermally insulating layer. Each polymeric foam board also has at least one major surface, a length, width and thickness. At least one, typically both, of the inside and outside surface of a polymeric foam board is a major surface of the polymeric foam board. A major surface is a surface having a planar surface area equal to or greater than the planar surface area of any other surface. A planar surface area is the surface area of a direct projection of the surface onto a plane and does not take into account surface area due to holes or hills in the surface topography. A major surface contains the length (the longest dimension of the major surface) and the width (dimension perpendicular to the length) of the polymeric foam board. The thickness of a polymeric foam board is mutually perpendicular to the length and thickness and is generally the dimension extending between the inside and outside surface of a polymeric foam board.

Polymeric foam boards of the present invention typically have a width of 1.2 meters (four feet) or more; a length of 2.4 meters (8 feet) or more, 3 meters (10 feet) or more or even 3.7 meters (12 feet) or more; and a thickness of 16 millimeters (0.625 inches) or more, 19 millimeters (0.75 inches) or more, 25 millimeters (one inch) or more, even 38 millimeters (1.5 inches) or more and that is typically 10 centimeters (four inches) or less in thickness. Polymeric foam boards within these dimensions offer desirable thermal insulating values.

Each polymeric foam board achieves a Class A rating according ASTM E-84 test procedures. This particularly stringent ASTM test procedure evaluates both flame spread and smoke production. Examples of suitable polymeric foam boards that are known to achieve a Class A rating in ASTME E-84 testing include a polyisocyanurate foam core bonded to a glass fiber reinforced 0.038 millimeter (1.5 mil) thick aluminum foil facer (for example, TSX-8500 insulation available from Rmax, Inc.) and polyisocyanurate foam core having glass fiber dispersed therein and bonded to an aluminum foil (sheet) facer (for example, THERMAX™ ci brand insulation, THERMAX is a trademark of The Dow Chemical Company). However, any polymeric foam board that achieves a class A rating in ASTM E-84 testing is expected to work in the present invention, provided it meets the additional requirements of the polymeric foam board described herein.

The continuously insulated wall assembly, and preferably each polymeric foam board, desirably has a thermal insulation value of more than 28 meters*Kelvin per Watt (m*K/W) (4 hour*square foot*degrees Fahrenheit per British Thermal Unit*inch ($h*ft^2*°$ F./Btu*in)), preferably 38 m*K/W (5.5 $h*ft^2*°$ F./Btu*in) or more, still more preferably 42 m*K/W (six $h*ft^2*°$ F./Btu*in) or more and yet more preferably 45 m*K/W (6.5 $h*ft^2*°$ F./Btu*in) or more. Measure thermal insulation values according to ASTM method C-518 at a mean temperature of 23.9 degrees (°) Celsius (75° F.).

Polymeric foam boards for use in the present invention can provide sufficient thermal insulating properties to a wall assembly that fiber batting is unnecessary within a cavity spacing between structural support members. Eliminating a need for fiber batting is desirable in a wall assembly to enhance movement of moisture that may enter the cavity spacing, which in turn enhances the rate at which moisture can escape from the cavity spacing relative to such a spacing containing fiber batting. Moreover, thermal insulating properties of the polymeric foam boards facilitate keeping the surface of the foam board as well as structural members from becoming cold enough to condense moisture. In wall assemblies that do not have an insulating component on sheathing over the outside surface of the structural members, heat can escape through the sheathing causing a cold surface to form on the sheathing exposed within the cavity spacing between structural members thereby providing a surface for moisture condensation. Metal structural members further serve as a thermal bridge from warm sheathing on the inside of the wall assembly to cold sheathing on the outside of the wall assembly, thereby serving to both create cold surfaces on the structural members and transfer heat through the wall from the inside surface. The thermally insulating layer of the present wall assembly serves to inhibit transfer of heat thereby inhibiting formation of a cold surface in the cavity spacing between structural support members on which condensation can occur as well as transfer of heat through the wall assembly through the structural support member thermal bridge.

The polymeric foam boards desirably have a density of 64 kilograms per cubic meter ($kg/m^3$) or less, preferably 48 $kg/m^3$ or less and typically have a density of 40 $kg/m^3$ or more. Determine density according to ASTM method C303-07.

The polymeric foam boards desirably have a compressive strength in a range of 170 kilopascals (25 pounds per square inch) to 207 kilopascals (30 pounds per square inch) and a modulus in a range of 5860 kilopascals (850 pounds per square inch) and 8300 kilopascals (1200 pounds per square inch). Measure compressive strength and modulus according to the test method of ASTM D-1621-04a.

Each polymeric foam board comprises a polymeric foam core having opposing inside and outside surfaces proximate respectively to the inside and outside surfaces of the polymeric foam board. Desirably, the outside surface and more desirably each of the inside and outside surfaces of the polymeric foam comprise a facer selected from facers comprising one or more of the following: a metal sheet layer and a coated glass fiber mat where the coating comprise a polymeric binder filled with inorganic filler such that 90-95 wt % of the coated glass fiber mat is a combination of glass and inorganic filler. When there are facers for both inside and outside surfaces of the polymeric foam, the facers on the inside and outside can be the same or different from one another. In a particularly desirable embodiment, the polymeric foam has an aluminum-containing facer on its outside surface. Preferably, an aluminum-containing facer is on both the inside and outside surface of the polymeric foam. The aluminum-containing facer desirably comprises a continuous aluminum sheet (sheet and foil are synonymous herein). A facer on a foam core typically serves as a surface on a polymeric foam board.

Desirably, both inside and outside surfaces of the polymeric foam comprise a facer comprising or consisting of a continuous aluminum sheet facer. Typically, the outside surface comprises an aluminum sheet, preferably a continuous aluminum sheet that has an average thickness of 0.076 millimeters (3 mils) or more, preferably 0.080 millimeters (3.15 mils) or more, and can be 0.086 millimeters (3.4 mils) or more, even 0.1 millimeters (four mils) or more. The facer on the inside surface of the polymeric foam can comprise an aluminum sheet identical to the aluminum sheet on the outside surface of the polymeric foam or can contain a different aluminum sheet. For example, the aluminum-containing facer on the inside surface of the polymeric foam can contain an aluminum sheet that is thinner, thicker or the same thickness as an aluminum sheet in a facer on the outside surface of the polymeric foam. The aluminum sheet in a facer on the inside surface of the polymeric foam is generally 0.025 millimeters (one mil) or more thick, preferably 0.032 millimeters (1.25 mils) or more thick and can be 0.051 millimeters (two mils) or more thick, or any of the thicknesses specified for the aluminum sheet suitable for the facer on the outside surface of the polymeric foam. Generally, the aluminum-containing facer on both the inside and the outside surfaces of the polymeric foam contains or consists of a continuous aluminum sheet that is 0.127 millimeters (five mils) or less and can be 0.1 millimeters (four mils) or less in thickness.

Aluminum sheets in the facers can further include a coating. Desirably, the aluminum sheet in the facer on the outside surface, inside surface or both surfaces of the polymeric foam include a thermoset polymer coating that remains exposed on the polymeric foam board. Suitable coatings include acrylic coatings (for example, latex acrylic coatings). Coatings are desirable, for example, to inhibit oxidation of the aluminum.

Aluminum facers are desirable both to achieve desirable flame test performance of the continuously insulated wall assembly and to provide durability to the thermally insulating layer during construction. When the polymeric foam boards contain facers with aluminum sheets that are 0.076 millimeters (3 mils) or more, preferably 0.080 millimeters (3.15 mils) or more still more preferably 0.086 (3.4 mils) thick or more, particularly 0.1 millimeters (four mils) or more on their outside surfaces, it becomes difficult to accidentally puncture the facer during handling of the boards and while the boards remain exposed during construction or assembly of the continuously insulated wall assembly. Therefore, the thermally insulating layer can remain exposed to elements of weather such as wind, rain and snow for extended periods of time (for example, six months or more) without suffering damage.

The polymeric foam core is desirably polyurethane foam. Polymeric foam has a continuous polymer phase and can contain non-polymeric components. Herein, "polyurethane" includes non-crosslinked polyurethanes and crosslinked polyurethanes (for example, polyisocyanurate). Desirably, the polymeric foam core is polyisocyanurate foam in order to maximize compressive strength.

The polymeric foam core may contain any individual or combination of the following additives: infrared attenuating agents (for example, carbon black, graphite, metal flake, titanium dioxide); clays such as natural absorbent clays (for example, kaolinite and montmorillonite) and synthetic clays; nucleating agents (for example, talc and magnesium silicate); flame retardants (for example, brominated flame retardants such as hexabromocyclododecane, phosphorous flame retardants such as triphenylphosphate, tris(2-chloroisopropyl) phosphate, and triethyl phosphate); flame retardant packages that may including synergists such as, or example, dicumyl and polycumyl); lubricants (for example, calcium stearate and barium stearate); surfactants (for example, those based on polydimethylsiloxane and polyethers); acid scavengers (for example, magnesium oxide and tetrasodium pyrophosphate), mineral fibers, glass fibers, Perilite, and fly ash. Total additive concentrations typically range from zero to 25 wt % of the total polymeric foam core weight.

It is not uncommon for wall assemblies in the prior art to incorporate vertical grooves in a component of a wall structure that serve as drainage channels and facilitate drainage of condensed moisture. The present continuously insulated wall assembly, and particularly the thermally insulating layer, can have vertical grooves (drainage channels) or may be free of vertical grooves (drainage channels). Drainage channels are not necessary in the continuously insulated wall assembly of the present invention.

The foam boards desirably have rabbeted edges that mate with a rabbeted edge of a neighboring foam board to form a flush joint between foam boards. Rabbeted edges are particularly desirable on the edges that run perpendicularly to studs in the support structure. Edges that run parallel to studs in the support structure can also, or as an alternative, have rabbeted edges that mate with the edge of an adjoining foam board. While rabbeted edges are not required on any edges of the foam boards, rabbeted edges are desirable for forming close-fitting joints that help preclude water penetration and air penetration at board joints. Rabbeted edges are particularly desirable on foam boards having a thickness of 3.8 centimeters (1.5 inches) or more.

The polymeric foam board resides proximate to the support structure such that the wall is free of any component layers that span the entire cavity between two or more structural elements in-between the support structure and an aluminum-containing facer on the polymeric foam board. Adhesives, caulks, and gasket material can reside along part of or the entire structural element in-between the structural element and the foam board and can be useful, for example, to aid in assembly of the wall structure and/or provide additional acoustical or vibrational dampening in the wall. Alternatively, the inside surface of the polymeric foam board can directly contact two or more structural elements defining a cavity that the polymeric foam board spans. In this alternative embodiment the inside surface of the thermally insulating layer directly contacts the structural members.

Fasten foam boards to the support structure using mechanical fasteners. Fasteners suitable for fastening the foam boards of the present invention to the support structure include any fastener recommended for attaching foam insulation to a support structure. Suitable fasteners include steel screw fasteners, preferably with a corrosion-resistant coating and more preferably in combination with a washer or plate (for example, Wind-Lock™ ULP-302 nonmetal washers with Wind-Lock ULP-3S fasteners; Wind-Lock is a trademark of Wind-Lock Corporation) that effectively increases the area of the screw head to as to inhibit the head from tearing through the foam board.

To minimize moisture and air permeability through the thermally insulating layer the continuously insulated wall assembly comprises sealing tape covering the seams between polymeric foam boards. Typically, apply the sealing tape over the seams after attaching the polymeric foam boards to the structural members. It is conceivable, though not preferable, to apply sealing tape over seams of abutting polymeric foam boards prior to attaching the polymeric foam boards to the structural elements. The sealing tape desirably extends over less than a complete major surface of any polymeric foam board to which the sealing tape is applied. The sealing tape generally has a width that is less than the length or width of a foam board, typically less than half of the length or width of a foam board. It is common for the sealing tape to have a width of approximately 10 centimeters (four inches). It is desirable for the sealing tape to be on the outside surface of the thermally insulating layer, but it can be on the inside surface of the thermally insulating layer either in addition to or instead of the outside surface. It is acceptable to use a primer (for example, Hi-Strength 90 Spray Adhesive from 3M) to increase adhesion of the sealing tape to the polymeric foam boards.

The sealing tape desirably contains a butyl rubber, rubberized asphalt or a combination thereof. In one desirable embodiment the sealing tape comprises both a layer of butyl rubber and a thermoplastic polyolefin layer, especially when the butyl rubber layer is 0.254 millimeters (10 mils) or more in thickness and is applied with the butyl rubber layer against the polymeric foam board. A particularly desirable sealing tape comprises a butyl rubber layer that is 0.254 millimeters (10 mils) or more, preferably 0.33 millimeters (13 mils) or more, and more preferably 0.41 millimeters (16 mils) or more thick and a thermoplastic polyolefin layer that is 0.08 millimeters (3 mils) or more thick.

The continuously insulated wall assembly further comprises a plurality (more than one) of fasteners that extend through the thermally insulating layer and serve as façade ties. The fasteners attach to, preferably penetrate into, and most preferably extend all the way through a structural element while also extending all the way through the thermally insulating layer and continuing beyond the outside surface of the thermally insulating layer. The fasteners can be threaded on one end or both ends. Desirably, the fasteners are threaded on one end and more desirably threaded on only one end for threading into the structural element. Threads on the end extending through and extending beyond the outside surface of the thermally insulating layer can undesirably provide channels along the threads through which water can penetrate into the thermally insulating layer. Desirably, seal any holes through the outsides surface of the thermally insulating layer that is around each fastener with, for example, a washer, gasket or sealing tape. In one embodiment, the fastener has a portion (for example, a washer or flared portion) that fits tightly against the outside surface of the polymeric foam board in order to create a seal against the foam board to inhibit moisture or air penetration through the polymeric foam board along the fastener. Optimally, the foam board will have a self-sealing tape or flashing on its surface through which the façade tie will penetrate. The self-sealing tape or flashing seals the point at which the façade tie penetrates into the polymeric foam board thereby inhibiting water and air penetration into the polymeric foam board at that point. Caulks, gaskets or other sealants are also suitable for sealing the point at which a façade tie penetrates into a polymeric foam board.

Attach a façade to the fasteners that extend from the outside surface of the insulating layer such that the sealing tape and thermally insulating layer are between the façade and support structure. The façade can be attached to the fasteners by constructing the façade so as to incorporate the fasteners within the façade (for example, constructing a brick wall with the fasteners extending into mortar between bricks in the brick wall). The façade can be one or more material selected from a group consisting of metal panel veneer, metal-composite-metal panels, fiber reinforced cementitious siding veneer, and any material having a thickness of at least 1.9 centimeters (0.75 inches) that qualifies as "non-combustible" according to ASTM E136. Examples of materials that qualify as "non-cumbustible" according to ASTM E136 include natural and man-made stone, brick, terra-cotta, limestone, stucco, granite and cementitious materials. The façade is desirably one or more than one material selected from a group consisting of brick, limestone, natural stone, stucco, terra-cotta, granite. This group of façade materials offers the optimal performance in code testing to the present continuously insulated wall assembly. The façade material desirably passes NFPA 285 testing criteria. In one desirable embodiment the façade comprises or consists of brick veneer. In another desirable embodiment the façade comprises or consists of a metal panel veneer. When the façade is a stucco veneer, the continuously insulated wall assembly further comprises a water-resistant barrier between the thermally insulating layer and the stucco façade layer. Suitable water-resistant barriers include commercial building wraps such as DOW STYROFOAM™ WEATHERMATE™ PLUS™ house wrap (STYROFOAM, WEATHERMATE and DOW STYROFOAM WEATHERMATE PLUS are trademarks of The Dow Chemical Company).

The façade can be in contact with the outside surface of the thermally insulating layer, but is desirably spaced apart from the thermally insulating layer thereby allowing a space between the façade and thermally insulating layer. Desirably, the façade is 1.27 centimeters (0.5 inches) or more, preferably 2.54 centimeters (one inch) or more and is typically five centimeters or less from the outside surface of the thermally insulating layer. The space between the façade and thermally insulating layer allows for any moisture that penetrates through the façade to drain away.

The continuously insulated wall assembly further desirably comprises a sealant material sealing gaps having an opening of less then 25 square millimeters between the inside and outside surfaces of the thermally insulating layer. The sealing material is desirable to increase the air barrier, vapor barrier and moisture barrier properties of the wall assembly. Sealing materials can be any material that forms a seal over openings. Examples of suitable sealing materials include epoxy coatings, liquid applied elastomeric coatings, latex coatings, sealing tape, and spray foam sealants. The sealant material desirably covers all of the openings less than 25 square millimeters in area between the inside and outside surfaces of the thermally insulating layer (preferably including any openings penetrating into structural elements around fasteners). In one preferred embodiment, sealant covers all portions of the thermally insulating layer, sealing tape and fasteners that would otherwise be exposed within the cavity between structural elements. In an even more preferred embodiment, the sealant further covers any portions of structural elements through which fasteners extending through the thermally insulating layer extend. Creating such a coating ensures small openings through the thermally insulating layer are sealed.

One particularly desirable sealant material is a polyurethane spray foaming composition, preferably a non-crosslinking polyurethane foaming composition. Non-crosslinking polyurethane foaming compositions are desirable because of their rapid cream time, which allows them to be sprayed on and remain in place rather than drip. It is desirable to apply the a spray foam sealant as a coating having an average thickness of 2.54 centimeters (one inch) or more within the cavity and can have a thickness of 3.8 centimeters (1.5 inches) or more within the cavity. Spray foam, particularly polyurethane spray foam, serves to enhance thermal, moisture and air barrier properties of the continuously insulated wall assembly. Desirably, the spray foam has one or more than one of the following properties: a density according to ASTM method D1622 of approximately 32 kilograms per cubic meter (2 pounds per cubic foot); a thermal resistance according to ASTM method C518 of approximately 37 m*K/W (5.4 $h*ft^2*°$ F./Btu*ft) or more after aging 180 days; a flame spread of 25 or less and a smoke developed value of 450 or less according to ASTM method E84, Class A; a compressive strength at 10% compression of at least 182 kilopascals (25 pounds per square inch; a water absorption value of 1.7 percent by volume or less according to ASTM method D2842; and a water vapor permeability value of 3.36 ng/(Pa*s*m) (2.3 perm-inches) or less according to ASTM method E96. Suitable polyurethane foams include STYROFOAM spray polyurethane foam CM2060 and CM2045, available from The Dow Chemical Company.

One of the surprising and desirable features of the present continuously insulated wall assembly is that is provides a continuous inherent insulated moisture barrier thereby precluding any need for a separate moisture barrier material on either the inside or outside surfaces of the structural elements. It also eliminates the need to determine whether to place the moisture barrier on the inside surface of the structural elements (desirable in environments where the "outside" temperatures tend to be lower than the "inside" temperature) or on the outside surface of the structural elements (desirable in the environments where the "inside" temperatures tend to be lower than the "outside" temperatures). Placing the moisture barrier on the wrong portion of a wall can result in trapping moisture within the wall and can result in undesirable condensation within the wall. The present continuously insulated wall assembly provides a moisture barrier on the outside surface that is also inherently thermally insulated. As a result, the temperature of surfaces within a cavity space between structural elements is thermally insulated from the cold environment on the "outside" thereby inhibiting condensation on cavity surfaces in environments where the outside temperatures tend to be lower than the "inside" temperatures. Moreover, a vapor barrier is unnecessary on the inside surface of the structural elements so vapor may transfer from the cavity space between structural elements to the "inside" of a structure with little hindrance, thereby inhibiting condensation on cavity surfaces in environments where the "inside" temperature is lower than the "outside" temperature. In a desirable embodiment of the present invention, the wall assembly is free of any vapor barrier material other than the polymeric foam boards. "Inside" refers to the space enclosed within the walls including the continuously insulated wall assembly and "outside" refers to the space not enclose by such walls.

Yet another advantage of the present continuously insulated wall assembly is that it is inherently insulating and in a continuous manner along the wall assembly. The insulated characteristic of the assembly can preclude need for fiber batting within cavity spacings between structural elements. Fiber batting is often used to increase thermal insulating value of a wall assembly. However, it also serves to exacerbate trapping moisture within the cavity spacing between structural members by: (1) insulating the cold surface within the cavity from warmth from the warmer surfaces thereby allowing the cold surface to get colder and induce more condensation than had the insulation not been present; and (2) dramatically increasing the path through which moisture must travel through the cavity space to escape from the cavity space. Trapped moisture can undesirably condense and promote mold and decomposition of wall materials.

Fiber batting can also be unpleasant to handle and install due to risks of inhaling glass fibers and unpleasant splinters of glass fiber that can imbed into the skin. The present wall assembly can be free from fiber batting within cavity spaces between structural elements, and the problems associated with fiber batting, and yet still achieve desirable thermal insulating value due to the thermally insulating properties of the thermally insulating layer. Still more, the continuous characteristic of the continuous insulating layer provides a barrier that precludes structural elements from forming the thermal short through the wall assembly. The thermally insulating layer extends over structural elements thereby insulating the structural elements from temperature fluctuations outside of the wall assembly.

The continuously insulated wall assembly is free of any gypsum sheathing layer or wood-based sheathing layer between the structural elements and the insulating layer. Moreover, the continuously insulated wall assembly can be free of any gypsum sheathing or wood-based sheathing layer that covers 50% or more of the continuously insulated wall assembly area covered by the thermally insulating layer and that resides on the same side of the support structure as the thermally insulating layer. Still more, the continuously insulated wall assembly can be completely free of gypsum sheathing, wood-based sheathing or both gypsum sheathing and wood-based sheathing on the same side of the support structure as the thermally insulating layer. Gypsum sheathing includes components such as drywall and exterior gypsum board. Wood-based sheathing has a thickness of 3.2 millimeters (0.125 inches) or more, typically 6.4 millimeters (0.25 inches) or more and includes components such as oriented strand board (OSB), fiberboard and plywood.

The continuously insulated wall assembly can further comprise a gypsum board layer that spans two or more structural elements on a side of the structural elements opposite the thermally insulating layer (that is, the inside of the continuously insulated wall assembly) so as to further enclose the cavity between structural elements and between the thermally insulating layer and the gypsum board layer.

Surprisingly, the continuously insulated wall assembly can meet critical building codes despite an absence of gypsum or wood-based sheathing on the outside of the support structure. The present continuously insulated wall assembly comprising a support structure with steel support elements, the thermally insulating layer with sealing tape over seams between polymeric foam boards, fasteners, one of the identified façades and polyurethane on the inside of the cavity as described above is suitable for Type I, II, III and IV buildings as defined by the International Building Code. The continuously insulated wall assembly meets the requirements of NFPA 285 for flame propagation, ASTM E-331 for water barrier property requirements, ASTM E-2357 for air barrier properties and each element of the continuously insulated wall assembly achieves Class A rating in ASTM E-84 flame spread and smoke development testing, as well as ASHRAE 90.1-2007 thermal insulation specifications including the requirement for continuous insulation. For example, these code requirements are met by a continuously insulated wall assembly of the present invention comprising: (a) a structural support comprising steel support elements with a cavity between the steel support elements; (b) an insulating layer comprising a plurality of polymeric foam boards each comprising a polyisocyanurate foam core with glass fiber dispersed therein and aluminum facers on opposing inside and outside surfaces wherein the aluminum facer on the inside surface contacting two or more steel support elements, the polymeric foam board achieves a Class A rating in ASTM E-84 testing and has a thermal insulating value of at least 28 m*K/W (four h*ft$^2$*° F./Btu*in); (c) sealing tape comprising a butyl rubber layer that is 0.25 millimeters (10 mils) or more, preferably 0.33 millimeters (13 mils) or more, still more preferably 0.4 millimeters (16 mils) or more thick and an polyolefin layer that is at least 0.08 millimeter (3 mils) thick covering seams between polymeric foam boards; (d) fasteners extending all the way through the thermally insulating layer and attached to the steel studs and extending beyond the outside surface of the thermally insulating layer; (e) a façade selected from a group consisting of metal panel veneer, metal-composite-metal panels, fiber reinforced cementitious siding veneer and materials having a thickness of at least 1.9 centimeters (0.75 inches) that qualify as "non-combustible" according to ASTM E136 attached to the fasteners and located within five centimeters of the outside surface of the thermally insulating layer; and (f) polyurethane foam that is at least 2.54 centimeters thick and thin enough to remain within the cavity of defined by the steel support elements covering any portions of (b)-(e) that may be exposed within the cavity between steel support elements. The continuously insulated wall assembly further desirably comprises a gypsum sheathing attached to and spanning two or more steel support elements on an opposite side of the steel support elements than the thermally insulating layer such that the gypsum sheathing encloses the cavity between the steel support elements that contains the polyurethane foam. The present continuously insulated wall assembly provides a lighter weight structure with fewer components to install that existing wall structures while still achieving desirable and necessary code performance.

A particularly desirable embodiment of the present invention concomitantly satisfies AHSRAE 90.1-2007 thermal insulating codes, including those prescribing a continuous thermal insulating layer, NFPA 285 flame propagation requirements for exterior non-load bearing wall assemblies, ASTM E331 water barrier property requirements, and ASTM E-2357 air barrier requirements. Desirably, all polymeric foam components in the particularly desirable embodiment qualify for a Class A rating in ASTM E-84 flame spread and smoke development testing.

One embodiment within this particularly desirable embodiment comprises the following components: (a) a support structure comprising steel studs having inside and outside surfaces and a depth of at least 9.25 centimeters (3.625 inches) (depth is the distance between inside and outside surfaces), a gauge of at least 20 and a spacing one from another of 61 centimeters (24 inches) or less and lateral bracing between studs approximately every 122 centimeters (4 feet) vertically; (b) polyisocyanurate foam boards having a thickness of 1.6 centimeters (0.625 inches) or more and 11 centimeters (4.25 inches) or less that meet ASTM E-84 Class A performance and desirably have an thermal insulating value of at least 28 m*K/W (four h*ft$^2$*° F./Btu*in) and that collectively form a thermally insulating layer continuously disposed on the outside surfaces of the steel studs, the polyisocyanurate foam boards having opposing inside and outside surfaces with the inside surface is most proximate to the steel studs and wherein the inside and outside surfaces of the boards have aluminum facers as previously described; (c) façade ties penetrating all the way through the polyisocyanurate foam boards and connected to the steel studs; (d) a sealing tape as previously described having a width of up to 10 centimeters (four inches) over all joints between boards of polyisocyanurate foam in the thermally insulating layer and at least a portion of such sealing tape to seal where the façade ties penetrates the thermally insulating layer; (e) a façade selected from stucco having a thickness of 1.9 centimeters (0.75 inches) or more, metal-composite-metal panels, metal panels, clay brick having a nominal 10 centimeter (four inch) thickness and terra-cotta within 5.1 centimeters of the thermally insulating layer and covering the thermally insulating layer and attached to at least one façade tie; (f) polyurethane foam having a thickness of up to 3.8 centimeters (1.5 inches) between steel studs and sealing most, preferably all gaps having an opening of less then 25 square millimeters between the inside and outside surfaces of the thermally insulating layer; (g) 1.6 centimeter (0.625 inch) thick Type X gypsum wallboard over the inside surfaces of the steel studs; and (h) a floorline fire stopping material such as 64 kg/m$^3$ density mineral wool between steel studs at each floorline where a spacing between steel studs would otherwise continue as an opening through the floorline.

Assemble this particularly desirable embodiment of a continuously insulated wall assembly of the present invention by: (a) providing a support structure comprising steel studs having inside and outside surfaces and a depth of at least 9.25 centimeters (3.625 inches) depth (that is, distance between inside and outside surface), a gauge of at least 20 and a spacing one from another of 61 centimeters (24 inches) or less and lateral bracing between studs approximately every 122 centimeters (4 feet) vertically; (b) providing polyisocyanurate foam boards having opposing inside and outside surfaces with a thickness between the inside and outside surfaces of 1.6 centimeters (0.625 inches) or more and 11 centimeters (4.25 inches) or less that meet ASTM E-84 Class A performance and desirably have a thermally insulating value of 28 m*K/W (four h*ft$^2$*° F./Btu*in) or more and attaching them to the outside surfaces of the steel studs so as to form a continuous thermally insulating layer around the outside of the support structure with the inside surfaces of the polyisocyanurate foam boards most proximate to the outside surface of the steel studs and wherein the inside and outside surfaces of the boards have aluminum facers as previously described;

(c) providing façade ties and positioning them all the way through the thermally insulating layer and into the steel studs; (d) providing a sealing tape as described earlier and having a width of up to 10 centimeters (4 inches) and applying it over the seams between polyisocyanurate foam boards of the thermally insulating layer and use at least portions of the sealing tape to seal where the façade ties penetrate the thermally insulating layer; (e) attach a façade selected from a group consisting of metal-composite-metal panels, metal panels, fiber reinforced cementitious siding veneer, and clay brick having a nominal 10 centimeter (four inch) thickness over the thermally insulating layer, attaching the façade to at least one façade tie wherein if the façade is clay brick it is within 5.1 centimeters of the thermally insulating layer; (f) providing and applying a polyurethane foam having a thickness of up to 3.8 centimeters (1.5 inches) between steel studs so to seal most, preferably all gaps having an opening of less then 25 square millimeters between the inside and outside surface of the thermally insulating layer; (g) providing and attaching 1.6 centimeter (0.625 inch) thick Type X gypsum wallboard over the inside surfaces of the steel studs; and (h) providing and installing a floorline firestopping material such as 64 kg/m$^3$ density mineral wool between steel studs at each floorline where a spacing between steel studs would otherwise continue as an opening through the floorline The following example serves to further illustrate an embodiment of the present invention and does not necessarily define the full scope of the present invention.

Figure 1B:
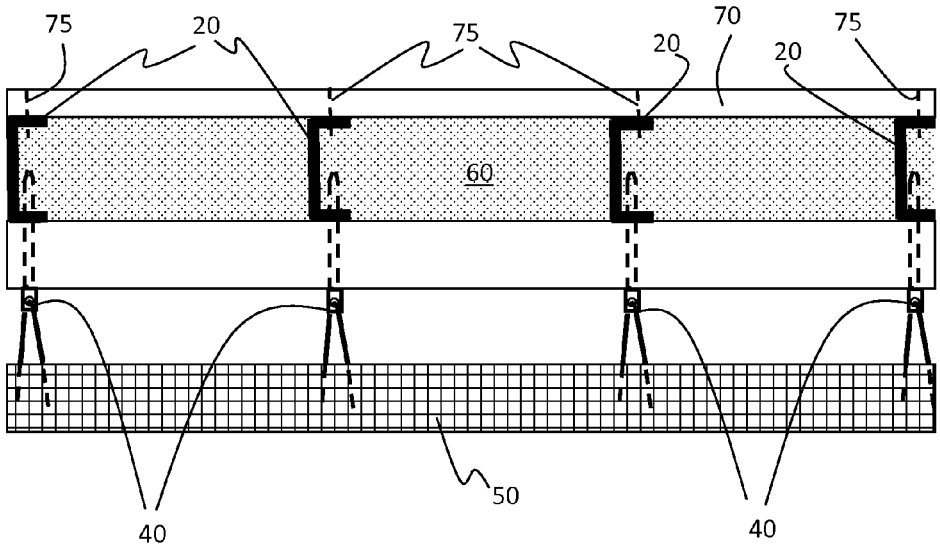

FIGS. 1*a* and 1*b* provide illustration of exemplary insulated wall assembly 10 of the present invention. Insulated wall assembly 10 comprises support structure 20, which itself comprises structural members 25 that define cavities 27. Thermally insulating layer 30 comprises polymeric foam boards 32 that abut one another forming seam 38. Polymeric foam boards 32 have inside surfaces 34 and outside surfaces 36. Sealing tape 40 extends over seam 38. Fasteners 50 extend through thermally insulating layer 30 and into structural members 25. Façade 60 is attached to fasteners 50 through "V-Channel" 55. Spray foam 70 resides within cavities 27 and gypsum board 80 encloses cavities 27 on a side of support structure 20 opposite thermally insulating layer 30. Insulated wall assembly 10 illustrates just one embodiment of the present invention.

EXAMPLE

FIGS. 1(*a*) and 1(*b*) provide illustrations of the following structure of the present invention.

Prepare a 2.4 meter (8 foot) by 2.4 meter (8 foot) support structure, 5, using 2.4 meter (8 foot) long, 9.2 centimeter (3.625 inch) deep 16 gauge steel studs 20 spaced 61 centimeters (2 foot) on center with bracing between studs every 61 centimeters along the 2.4 meter length. Use appropriate top and bottom track materials 25 along the top and bottom of the steel studs 20. For example, use Dietrich DSJ studs with complimentary top and bottom tracks. The support structure 5 has an inside surface and an opposing outside surface spaced apart by the depth of the studs 20.

Apply two 2.4 meter (8 foot) by 1.2 meter (4 foot) boards of 1.6 centimeter (0.625 inches) thick THERMAX™ ci exterior insulation (THERMAX is a trademark of The Dow Chemical Company) onto the outside surface of the support structure so as to cover the outside surface of the support structure and form a continuous thermally insulating layer 30. The thermally insulating layer 30 has opposing inside and outside surfaces, the inside surface being most proximate to the support structure 5. The inside surface of each THERMAX ci exterior insulation board includes a 1.25 mil thick embossed aluminum sheet facer with tinted thermoset wash-coat over the aluminum sheet facer. The outside surface of the THERMAX ci exterior insulation board includes a 3.15 mil thick aluminum sheet facer with a cross-linked thermoset coating over the aluminum sheet facer. Attach the two boards of THERMAX ci exterior insulation 30 to the support structure 5 using self tapping steel stud screws 32 such as Wind-Lock™ ULP-3S fasteners (Wind-Lock is a trademark of Wind-Lock Corporation). Apply fasteners 32 20.3 centimeters (8 inches) on perimeters and 30.5 centimeters (12 inches) on field.

Seal all seams 37 between foam boards 30 with 10.2 centimeter (four inch) wide WEATHERMATE™ straight flashing 35 (WEATHERMATE is a trademark of The Dow Chemical Company). The flashing 35 should cover the self tapping steel stud screws as well as the seam 37 between boards.

Install façade ties 40 (for example POS-I-TIE™ metal masonry anchors for use with brick façade, POS-I-TIE is a trademark of Cinco DL LLC) all the way through the thermally insulating layer 30, through the outside surface and attach to a steel stud 20. Seal the thermally insulating layer around the façade ties using WEATHERMATE straight flashing. The façade ties 40 extend beyond the outside surface of the thermally insulating layer 30.

Apply a clay brick façade 50 (four inch thick brick) over the outside surface of the thermally insulating layer 30 and incorporate the façade ties 40 into the façade 50. Install the façade 50 so that there is a space of 10 centimeters (four inches) or less between the façade 50 and outside surface of the thermally insulating layer 30.

Apply a spray polyurethane foam insulation 60 (for example, STYROFOAM™ brand spray polyurethane CM2060 or CM2045; STYROFOAM is a trademark of The Dow Chemical Company) to the inside surface of the thermally insulating layer 30 so as to form a foam thickness of 2.54 to 3.8 centimeters (one to 1.5 inches) that covers any exposed inside surface of the thermally insulating layer 30.

Apply 1.59 centimeter (0.625 inches) thick Type X Gypsum wallboard 70 over the inside surface of the support structure 5 to form a continuous wall. Attach the wallboard 70 to the support structure 5 using mechanical fasteners 75 such as screws, preferably self-tapping non-corrosive screws.

The resulting structure 10 is one exemplary embodiment of the present invention. The resulting structure 10 meets the following standards: ASHRAE 90.1-2007 commercial construction requirement for continuous thermal insulation; NFPA 285 flame propagation requirements; ASTM E-331 water barrier property requirements, revealing no water leakage when tested for 2 hours at pressures of 1.24, 6.24, 12 and 15 pounds per square inch water pressure; ASTM E-2357 air barrier property requirements, demonstrating less than 0.01 cubic foot per minute air permeability.

Conduct ASTM E-331 and E-2357 testing using the above wall structure 10 without the Type X Gypsum inner wall 70 or façade 50—both of which are expected to only improve results. Furthermore, include an Aluminum block-out to simulate a closed window, the size of which is specific to the test method. Shim the aluminum block-out into a window opening and seal with GREAT STUFF PRO™ spray polyurethane insulation (GREAT STUFF PRO is a trademark of The Dow Chemical Company). Place the wall structure on wooden bucks and seal any imperfections in the wooden bucks with caulk.

Similar results are expected for wall structures of the present invention that incorporate any combination of the following variations:

(1) Thermally insulating layer having any thickness between 1.59 and 10.8 centimeters (0.625 and 4.25 inches);

(2) Use of a façade selected from a group consisting of four-inch clay brick, stucco having a thickness of 1.9 centimeters (0.75 inches) or more, and any metal-composite-metal system that has been successfully tested by the panel manufacture via the NFPA 285 test method and terra-cotta; and (3) inclusion of fiberglass batting insulation between the thermally insulating layer and the Type X gypsum board layer.

What is claimed is:

1. A process for assembling a continuously insulated wall assembly comprising the following steps:

(a) providing a support structure comprising structural members spaced apart from one another so as to define a cavity between structural members;

(b) providing a thermally insulating layer comprising a plurality of polymeric foam boards each having a polyurethane foam core and having opposing inside and outside surfaces with the inside surfaces attached to two or more of the structural members so as to create a cavity defined by structural members and the thermally insulating layer, the polymeric boards abutting one another with seams where the boards abut and characterized by achieving a Class A rating according to ASTM E-84 test procedures and by having an R-value of greater than 28 meters*Kelvin per Watt (4 hour*square foot*degrees Fahrenheit per British Thermal Unit*inch);

(c) providing a sealing tape that contains butyl rubber, rubberized asphalt, or both and covering the seams between polymeric foam boards with the sealing tape;

(d) providing a plurality of fasteners and affixing them all the way through the thermally insulating layer to structural members such that the fasteners extend beyond the outside surface of the thermally insulating layer; and (e) attaching a façade to one or more than one of the plurality of fasteners and within five centimeters of the thermally insulating layer such that the thermally insulating layer and sealing tape are between the structural members and the façade, the façade being selected from a group consisting of metal panel veneer, metal-composite-metal panels, fiber reinforced cementitious siding veneer and materials having a thickness of at least 1.9 centimeters that qualify as "non-combustible" according to ASTM E136;

(f) applying a polyurethane foam sealant within the cavity defined by the structural members and thermally insulating layer in a manner that seals air gaps having an opening of less than 25 square millimeters between the inside and outside surface of the thermally insulating layer;

the process further characterized by being free of application of a gypsum sheathing layer or wood-based sheathing layer between the structural members and thermally insulating layer.

2. The process of claim 1, wherein the façade is selected from a group consisting of man-made stone, brick, terra-cotta, limestone, stucco, granite and cementitious materials where the materials of the group have a thickness of at least 1.9 centimeters.

3. The process of claim 1, wherein the polymeric foam boards of the thermally insulating layer have as an outside surface a facer selected from facers comprising one or more of the following: a metal sheet layer and a coated glass fiber mat where the coating comprise a polymeric binder filled with inorganic filler such that 90-95 wt % of the coated glass fiber mat is a combination of glass and inorganic filler.

4. The process of claim 1, further comprising fastening the thermally insulating layer to the support structure using a plurality of second mechanical fasteners.

5. A continuously insulated wall assembly comprising the following elements:

(a) a support structure comprising structural members spaced apart from one another and defining a cavity between any two structural members;

(b) a thermally insulating layer comprising a plurality of polymeric foam boards each having a polyurethane foam core and having opposing inside and outside surfaces with the inside surfaces attached to two or more of the structural members so as to create a cavity defined by structural members and the thermally insulating layer, the polymeric boards abutting one another with seams where the boards abut and characterized by achieving a Class A rating according to ASTM E-84 test procedures and by having an R-value of greater than 28 meters*Kelvin per Watt (4 hour*square foot*degrees Fahrenheit per British Thermal Unit*inch);

(c) sealing tape covering seams where the polymeric foam boards abut one another;

(d) a plurality of fasteners that are affixed to structural members and all the way through the thermally insulating layer and that extend beyond the outside surface of the thermally insulating layer;

(e) a façade attached to one or more of the plurality of fasteners and located within five centimeters of the thermally insulating layer such that the thermally insulating layer and the sealing tape are between the façade and support structure; the façade being selected from a group consisting of metal panel veneer, metal-composite-metal panels, fiber reinforced cementitious siding veneer and materials having a thickness of at least 1.9 centimeters that qualify as "non-combustible" according to ASTM E136; and (f) a polyurethane foam sealant within the cavity defined by the structural members and thermally insulating layer that seals air gaps having an opening of less than 25 square millimeters between the inside and outside surface of the thermally insulating layer wherein the continuously insulated wall assembly is free of any gypsum sheathing layer or wood-based sheathing layer between the support structure and the thermally insulating layer.

6. The continuously insulated wall assembly of claim 5, wherein the façade is selected from a group consisting of man-made stone, brick, terra-cotta, limestone, stucco, granite and cementitious materials where the materials of the group have a thickness of at least 1.9 centimeters.

7. The continuously insulated wall assembly of claim 1, wherein the polyurethane foam sealant covers all portions of the thermally insulating layer, sealing tape and plurality of fasteners that would otherwise be exposed within the cavity defined by the support structure and the thermally insulating layer.

8. The continuously insulated wall assembly of claim 1, wherein the polyurethane foam sealant forms a layer over the thermally insulating layer that has an average thickness of 2.54 to 5.08 centimeters thick.

9. The continuously insulated wall assembly of claim 1, further characterized by the polymeric foam boards of the thermally insulating layer having as an outside surface a facer selected from facers comprising one or more of the following:

a metal sheet layer and a coated glass fiber mat where the coating comprise a polymeric binder filled with inorganic filler such that 90-95 wt % of the coated glass fiber mat is a combination of glass and inorganic filler.

10. The continuously insulated wall assembly of claim 1, further characterized as being free of any gypsum sheathing layer that covers 50% or more of the area covered by the thermally insulating layer and on the same side of the support structure as the thermally insulating layer and sealing tape.

11. The continuously insulated wall assembly of claim 1, further characterized as being free of any gypsum sheathing layer on the same side of the support structure as the thermally insulating layer and sealing tape.

12. The continuously insulated wall assembly of claim 1, further characterized as being free of vertical drainage channels on the inside surface, outside surface or both inside and outside surface of the thermally insulating layer.

13. The continuously insulated wall assembly of claim 1, further characterized by the sealing tape extending over less than an entire polymeric foam board in contact with the sealing tape.

14. The continuously insulated wall assembly of claim 1, further characterized by a space of 2.5-5 centimeters between the thermally insulating layer and the façade.

15. The continuously insulated wall assembly of claim 1, further comprising a gypsum board layer on a side of the structural members opposite the thermally insulating layer such that the gypsum board serves to further enclose a cavity defined by the support structure and the thermally insulating layer.

16. The continuously insulated wall assembly of any of claims 5-6 and 7-15, further comprising a plurality of second mechanical fasteners that attach the thermally insulating layer to the support structure.

* * * * *

UNITED STATES PATENT AND TRADEMARK OFFICE

CERTIFICATE OF CORRECTION

PATENT NO. : 8,397,465 B2
APPLICATION NO. : 12/483331
DATED : March 19, 2013
INVENTOR(S) : Hansbro et al.

It is certified that error appears in the above-identified patent and that said Letters Patent is hereby corrected as shown below:

In the Claims:

Column 18, line 54, delete "1" and insert --5--.
Column 18, line 60, delete "1" and insert --5--.
Column 18, line 64, delete "1" and insert --5--.
Column 19, line 5, delete "1" and insert --5--.
Column 19, line 10, delete "1" and insert --5--.
Column 19, line 14, delete "1" and insert --5--.
Column 20, line 1, delete "1" and insert --5--.
Column 20, line 5, delete "1" and insert --5--.
Column 20, line 8, delete "1" and insert --5--.

Signed and Sealed this
Eleventh Day of June, 2013

Teresa Stanek Rea
*Acting Director of the United States Patent and Trademark Office*